United States Patent [19]

Saltzman et al.

[11] 4,276,751

[45] Jul. 7, 1981

[54] ICE MAKING MACHINE

[76] Inventors: Robert N. Saltzman, 7420 SW. 163rd St., Miami, Fla. 33157; Bruce Burrell, 145 NE. 121 Ter., N. Miami, Fla. 33161

[21] Appl. No.: 940,908

[22] Filed: Sep. 11, 1978

[51] Int. Cl.[3] ..... F25C 1/12

[52] U.S. Cl. ..... 62/138; 62/155; 62/352

[58] Field of Search ..... 62/155, 138, 139, 352

[56] References Cited

U.S. PATENT DOCUMENTS

| | | | |
|---|---|---|---|
| Re. 26,596 | 6/1969 | Jobes | 62/155 X |
| 3,009,336 | 11/1961 | Bayston et al. | 62/135 X |
| 3,170,304 | 2/1965 | Hale | 62/155 |
| 3,170,305 | 2/1965 | Dibble et al. | 62/155 |
| 3,273,352 | 9/1966 | McCready | 62/155 |
| 3,423,952 | 1/1969 | Pugh | 62/138 |
| 3,964,270 | 6/1976 | Dwyer | 62/138 |

*Primary Examiner*—William E. Tapolcai, Jr.
*Attorney, Agent, or Firm*—Robert W. Fiddler

[57] ABSTRACT

An automatic ice making machine employing a compression refrigeration system permitting utilization of a single compressor and condenser coil to provide cooled liquid refrigerant for one or more remote evaporator coils, each evaporator coil arranged in heat exchange relationship with a separate group of ice forming cells. A pressure responsive timer terminated control system is employed to control the cycle of operation of the ice making machine. The control system is relatively inexpensive in production and maintenance and acts to implement the operation of the evaporators in a desired flooded condition insuring the attainment of a relatively uniform cooling gradient across the ice forming cells.

5 Claims, 2 Drawing Figures

ICE MAKING MACHINE

BACKGROUND OF THE INVENTION

This invention relates to the art of ice making machines, and more particularly to an improved ice making machine employing a compression refrigeration system for the production of ice, by freezing a given quantity of water in an ice forming enclosure, and harvesting and collecting the formed ice, with the machine cycled through its freezing and harvesting operations to provide a continuous supply of a given quantity of ice.

A variety of machines have previously been evolved for automatically producing ice cubes. Such previously evolved ice making machines have employed a compression refrigeration system having a refrigerant compressor and condenser coupled in a refrigerant flow circuit with an evaporator coil arranged in heat exchange relationship with an ice forming enclosure such as a grid of ice forming cells having a movable closure platen at the bottom of the cells, as shown by U.S. Pat. Nos. 3,009,336; 3,277,661; 3,850,005; and 3,964,270. As disclosed in U.S. Pat. No. 3,009,336, it is recognized that a plurality of separate ice making machines, each with its own compression refrigeration system may be conjoined by stacking one above the other, with the ice produced by one grid dropping through a lower machine into a common bin. Each of these ice making machines, though feeding their output to a common ice collecting bin employs separate compressor systems, and separate control systems, increasing the cost of the apparatus, and the volume requirements for the installation of the apparatus.

The expense of providing separate compressors, compressor motors and a condenser and condenser fan for each set of ice forming cells results in obvious inefficiencies. Further, the heat generated by the compressor/condenser units enclosed within a housing common to the ice forming cells decreases the efficiency of operation of these units.

Additionally, problems of accuracy and maintenance were found in control systems employed to regulate the operation of the prior art ice making machines so as to produce the desired sequence of freezing and harvesting cycles. Thus, in the machine disclosed in U.S. Pat. No. 3,009,336, desired control is achieved by employing a weight control utilizing a so-called "pilot tank" and "control stream nozzle." The nozzle diverts the supply water from the pilot tank when the cells of the ice forming grid are filled, reducing the water in the pilot tank causing it to lighten and permit actuation of a circuit initiating ice harvest. As is apparent, the accuracy of this pilot tank often leaves much to be desired, and production costs and maintenance and adjustment requirements are generally excessive.

In U.S. Pat. No. 3,277,611, an attempt was made to eliminate the problems with the pilot tank by utilizing a thermostatic temperature response arrangement, with the thermostat sensing temperatures in the ice forming chamber, presumably indicative of the presence of ice. A plurality of thermostats were employed, one thermostat responsive to a first relatively high temperature indicative of the fact that there is no ice in the freezing chamber to initiate the freezing cycle; and a second thermostat responsive to a given low temperature indicative of the fact that any water in the freezing chamber would be frozen. Though the use of thermostat controls eliminates the problems with the pilot tank, it is found that with aging, and irregularities in the ambient atmosphere in which the ice making equipment is located, relatively extensive servicing of the equipment is required to adjust and maintain the setting of the thermostats to maintain the desired freezing.

In U.S. Pat. No. 3,964,270, it was attempted to eliminate the problems of thermostat maintenance by combining a timer with a single thermostat, on the assumption that when a given temperature has been attained for a given period of time, either desired harvesting or ice formation had been obtained. However, it is found that with time, even utilizing a single thermostat, temperature measurements are inaccurate, and maintenance problems increase.

Even with all of the aforedescribed systems, where it is desired to employ a single compressor/condenser assembly to handle a plurality of separate evaporators, no control system responsive only to the conditions in any one of the refrigerant compartments would suffice to provide desired operation.

BRIEF DESCRIPTION OF THE INVENTION

It is with the above considerations and desiderata in mind that the present improved ice cube making machine has been evolved, permitting a single compressor/condenser assembly to be employed in combination with a plurality of remotely spaced evaporators arranged in heat exchange relationship with a plurality of separate ice cube forming grids. Control of desired ice making and ice harvesting is accomplished by a pressure responsive control coupled to a timer to initiate harvesting when a given pressure in the evaporator line has been attained, and to initiate freezing after a given time interval which has been empirically determined to be sufficient to effect desired harvesting.

It is accordingly among the primary objects of this invention to provide an improved ice making machine with an improved control system providing for automatic cycling of the machine through freezing and ice harvesting cycles to insure the formation of desired ice cubes.

A further objects of the invention is to provide an automatically operated ice making machine in which a plurality of ice forming grids may be arranged in a relatively small space with a single remotely positioned compressor/condenser assembly serving to provide desired refrigerant effects.

An additional object of the invention is to minimize the effect of the exhaust heat of the compressor/condenser assembly of an ice making machine on the ice forming evaporator components.

Another object of the invention is to provide an automatically operated ice making machine having a control device subject to simple selective adjustments, without requiring the services of skilled mechanics.

These and other objects of the invention which will become hereinafter apparent are attained by providing a cycle control utilizing a pressure responsive switch coupled into an electrical circuit with a timer and coupled into a control circuit for the ice making machine. The ice making machine here provided utilizes a plurality of ice forming enclosures generally in the form of grids defining a plurality of ice cube shaped compartments. The ice forming enclosure or grid is formed with a closed upper surface, and an open lower surface, such that any ice formed within the compartment may be discharged through the lower surface. A refrigerant evaporator coil is arranged in heat exchange relationship with this ice forming enclosure, with a separate evaporator coil provided for each of the plurality of enclosures. A closure in the form of a movable platen is pivoted at one side of the enclosure for closing the lower opening of the enclosure. This platen serves the three-fold function of (1) delivering water to be frozen to the enclosure; (2) confining the water in the enclosure during the freezing cycle; and (3) acting as a discharge guide for the ice as it is being harvested from the enclosure. An actuating motor is mechanically coupled to the platen to effect desired movement of the platen between an ice forming enclosure closing position and a harvesting position remote from the enclosure closing position. A plurality of assemblies of ice forming enclosure, refrigerant evaporator, and platen may be arranged within a common housing, one above the other with sufficient spacing therebetween to permit free swinging of the platen with an ice delivery chute arranged at one side of the platen and housing leading to a common ice collecting bin. Each of the plurality of refrigerant evaporator coils is coupled to a common remotely positioned compressor/condenser assembly of a compression refrigeration system, provided with valving which controls the flow of refrigerant to the evaporators providing cold evaporating refrigerant during the freezing cycle, and hot refrigerant during the harvesting cycle.

The control means includes a selectively adjustable variable interval timer coupled to a refrigerant pressure responsive switch arranged in the refrigerant line to the evaporator. When the pressure in the refrigerant line drops to a point (generally of about 18 psi) indicating that the ice in the evaporator is ready for harvest, the down windings of the actuator motor are energized, bringing the platen down, bringing a toggle switch to a defrost position. At this time, the freezing cycle is terminated, and the defrost is initiated, simultaneously setting the timer into operation. When the timer has run its pre-selected interval, which has been empirically determined as sufficient to effect harvesting of the formed ice, the contacts in the timer will change position; that is the switch initially in one position will be thrown to another, to energize the up windings of the actuator motor, bringing the platen up. In its upward movement it also brings the toggle switch to its original up position, resetting the machine to its refrigeration cycle.

It is an important feature of the invention that the exhaust heat produced by the compressor/condenser assembly does not effect the ice forming efficiency of the evaporator, since the evaporator is located at a point remote from the compressor/condenser.

BRIEF DESCRIPTION OF THE DRAWINGS

A written description of the specific details of a preferred embodiment of the invention, and of the manner and process of making and using it, and of the best mode contemplated for practicing the invention will be described in full, clear, concise and exact terms, in conjunction with the accompanying drawings, wherein.

DESCRIPTION OF PREFERRED EMBODIMENT

The ice forming assembly 10 comprising the ice forming enclosure 14, arranged in heat exchange relationship with the evaporator coils 16, and having a platen 18, is of the type disclosed in the aforementioned U.S. Pat. No. 3,009,336 to Bayston et al, and U.S. Pat. No. 3,964,270 to Dwyer.

Figure 1:
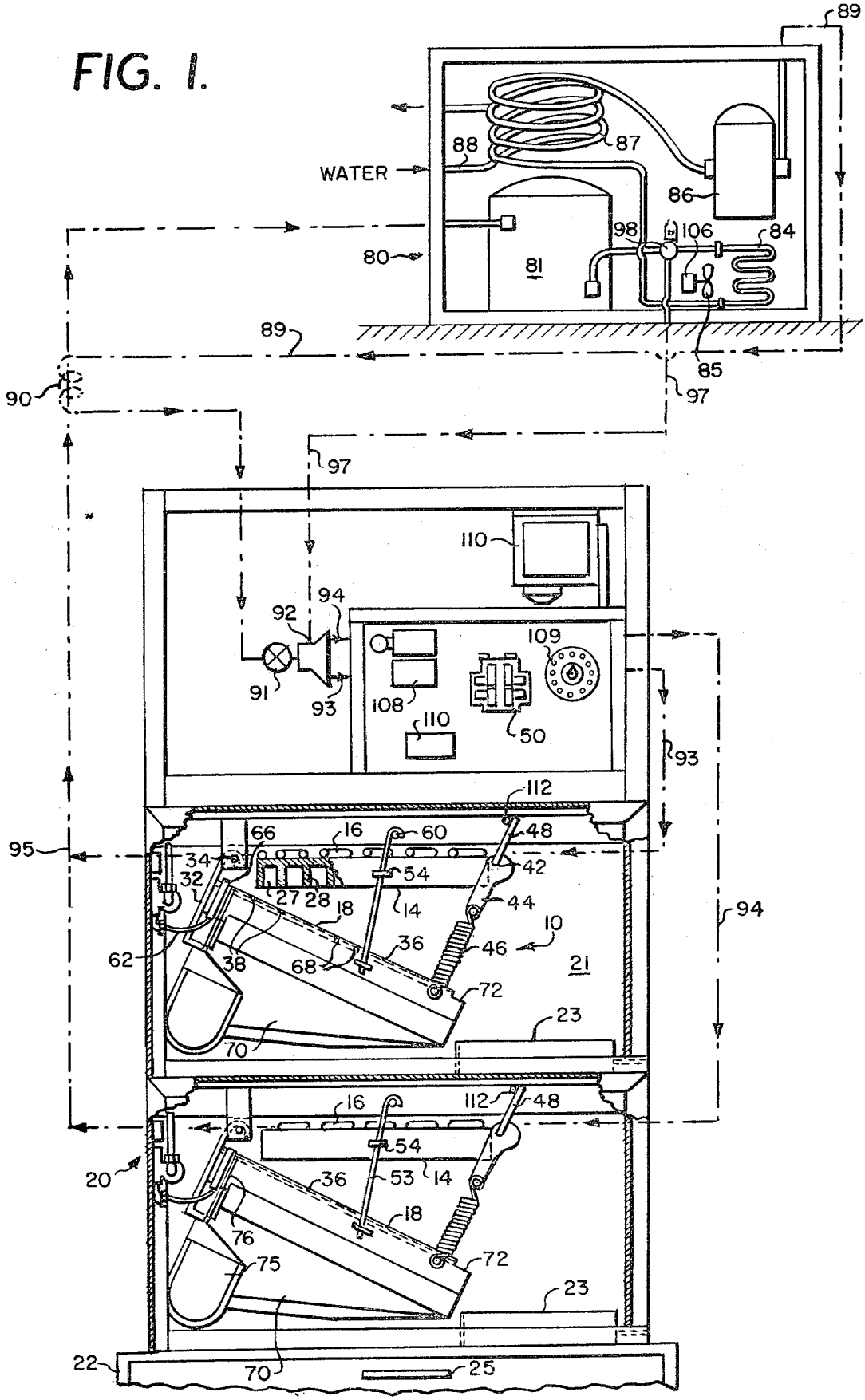
FIG. 1 is a schematic front elevational view showing a typical installation of a plurality of ice making evaporator assemblies in a single housing arranged remotely with respect to a compressor/condenser assembly, as seen at the upper right of the drawing.

Thus, as shown in FIG. 1, the ice making apparatus embodying the instant inventive concept is illustratively shown as installed with two ice forming assemblies 10 arranged within a housing generally designated 20, which is formed as conventionally of interconnected angle irons arranged to define generally rectangular compartments 21, shown as arranged one above the other. The housing 20, as illustratively shown in FIG. 1 is provided with an ice collecting bin 22 at the lower end thereof, and formed with openings 23 aligned one above the other in the compartments 21 defined by the housing 20, so that ice may be discharged from an upper housing compartment through a lower housing compartment to the ice bin 22. The ice forming assembly 10, as illustratively shown in FIG. 1 and as will be understood by those skilled in the art, is arranged to one side of the compartment openings 23, and positioned so that when the platen 18 is in the illustrated lowermost harvesting position, the lower lip of the platen 18 will feed any ice released from the cells 14 to the openings 23, this mode of operation being fully described in the above referred to prior patents, as readily understood by those skilled in the art. The ice collecting bin 22 is illustratively shown as provided with a front door, having handle 25 to permit opening of the door to provide access to the bin. Appropriate insulation is provided along the walls of housing 20 and the bin to minimize the effects of the ambient atmosphere on the ice.

The ice forming enclosure 14 is preferably formed of a grid of ice cube shaped cells 27, separated by walls 28, each cell 27 being preferably cube shaped, as described in the aforementioned prior art. The upper wall of the cells 27 is closed and arranged in heat exchange relationship with the coils of the refrigerant evaporator 16.

The combined water supply and closure plate or platen 29 is supported on bracket 32 pivoted on pivot pin 34, anchored in the framework of housing 20, thus permitting the platen 18 to move between a position underlying the grid 14 and closing off cells 27 and the position illustrated in FIG. 1. Platen 18 is provided with water ducts 36 arranged in the platen trained to pass beneath each of the cells 27 of grid 14.

Figure 2:
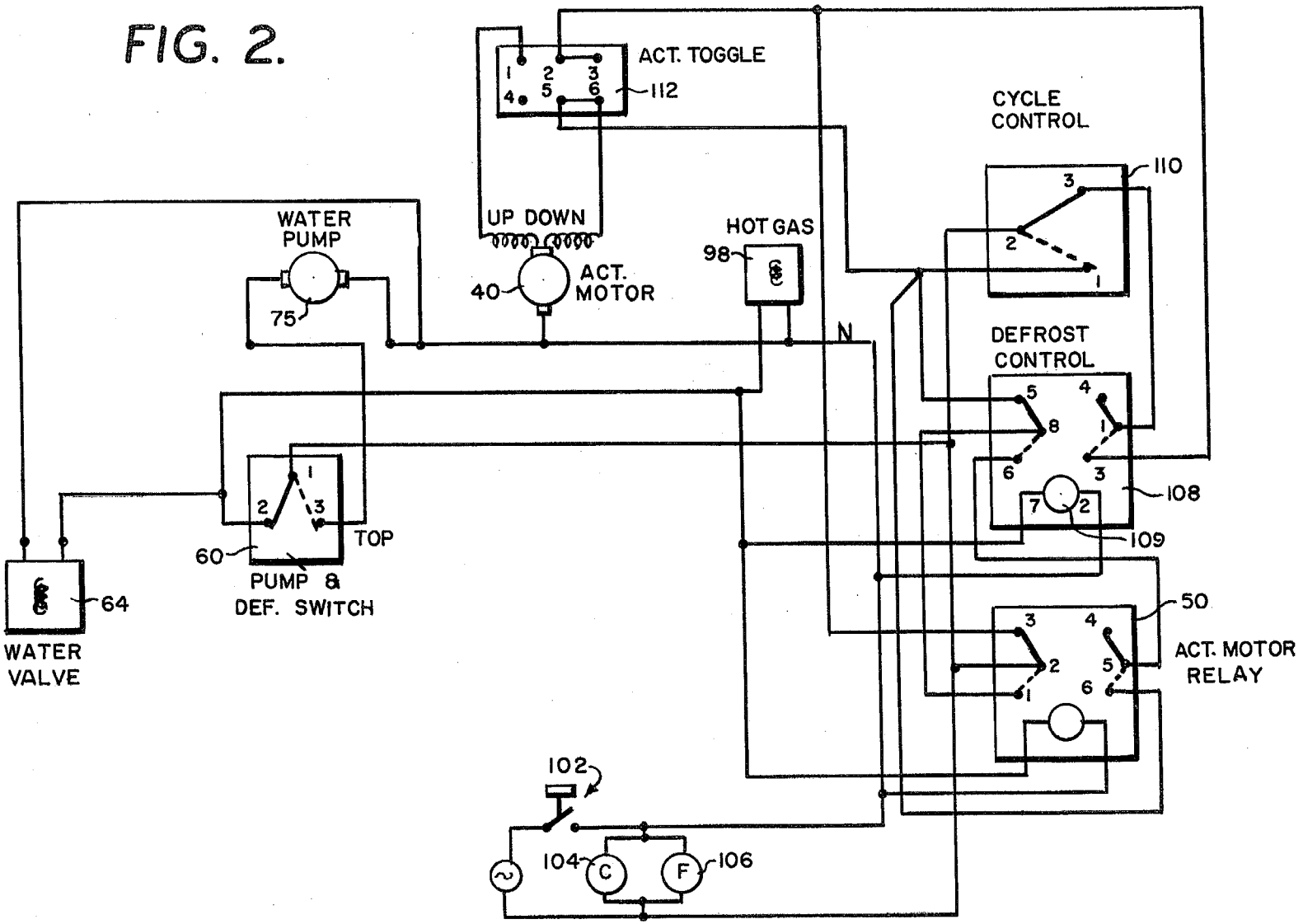
FIG. 2 is a schematic wiring diagram showing the control circuitry for the ice making apparatus for the invention.

A platen actuating motor 40, as schematically shown in FIG. 2, is coupled to the platen 18 by a motor shaft 42 (shown to the right in FIG. 1) connected to connecting rod 44, having spring 46 between the free end of connecting rod 44 and the free end of platen 18.

As shown schematically in FIG. 2, actuating motor 40 is provided with up windings and down windings. Thus the motor may rotate shaft 42 in either a clockwise or counterclockwise direction, as viewed in FIG. 1, to provide either an upward or downward motion for the platen 18. As the connecting rod 44 rotates in a clockwise direction, the platen 18 is brought up against the bottom of grid 14, and is resiliently held there by means of spring 46. An extension 48 on connecting rod 44 remote from spring 46 contacts actuator motor toggle switch 112, as seen at the upper center in FIG. 2, which consists of two double throw switches.

Push rod 53 is secured to the frame of platen 18 and extends through a guide plate 54 on the grid 14 with the upper end of rod 53 engaging the toggle of water pump and defrost valve toggle switch 60, which is normally spring biased to a downwardly extending position, making the solid line circuit between contacts 1,2 as shown in FIG. 2, as will be hereinafter more fully described.

WATER SUPPLY

Water is supplied to the ice forming grids 14 by a water supply line 62, the passage of water through which is controlled by solenoid actuated water valve 64, as schematically shown in FIG. 2. The water from supply line 62 is preferably discharged through a header 66 extending across the top edge of platen 18, permitting the water to flow over the top surface of platen 18, draining through holes 68 in the platen, and dropping into a water pan 70 secured beneath the platen 18 and moving therewith, all as described and illustrated in U.S. Pat. No. 3,964,270. The leading edge of the water pan projects beyond the platen 18 to provide a water entry space 72, as shown in FIG. 1. Any water not draining through the openings 68 in the platen will thus flow over the leading edge of the platen through the water entry space 72, into the water pan 70. The volume of water introduced into water pan 70 is substantially equal to the amount of water required to produce the ice cubes. Water pan 70 is filled when the tank is in down position. Water pump 75 is coupled to pan 70 to receive the water therefrom, and the outlet 76 of pump 75 is coupled to water distribution ducts 36 in the platen 18. The water supplied to the ducts 36 is discharged from the water supply ducts 36 through platen openings 38 into the cells 27 when the pump 75 is operating. Any water which is not immediately frozen will fall through the drain holes 68 in the platen back to the water pan 70. Thus, the water in pan 70 will be recirculated until frozen into ice cubes.

REFRIGERATION SYSTEM

A compression refrigeration system is employed to effect desired freezing, and is schematically shown in FIG. 1.

The compressor/condenser assembly 80 is schematically shown at the upper right in FIG. 1 as remotely located with respect to the evaporator-platen assembly above described. The compressor/condenser assembly 80 includes a compressor 81 for compressing gaseous refrigerants, such as freon or the like, which is fed to condenser coils 84, which are illustratively shown as air cooled by fan 85, such as they would be were the compressor/condenser assembly 80 located on a roof or at some other point having an available supply of relatively cool air.

The cooled refrigerant leaving the condenser coil 84 is ideally in a completely liquid state, and is fed to reservoir 86. To insure the fact that the refrigerant leaving the condenser 84 has been completely liquified it may be desirable to pass the refrigerant from the condenser 84 through a heat exchanger 87, as illustratively shown, with a water jacket 88 providing desired cooling effects in the heat exchanger. The liquid refrigerant is then fed from reservoir 86 through high pressure liquid line 89 (shown schematically by dot-dash line, with arrows indicating the direction of refrigerant flow) through auxiliary heat exchanger 90, to expansion valve 91, to distributer 92, which may be of a type such as Sporlan distributer 16.54.

In the illustrated preferred embodiment of the invention, the evaporator coils 16 of the plurality of ice forming assemblies are shown arranged in parallel with the refrigerant from the expansion valve 91 passing through the distributer 92, split into two refrigerant flow paths 93 and 94 leading through the pressure sensing elements of the hereinafter described controls, with line 93 providing expanding liquid refrigerant to the upper illustrated evaporator 16 and line 94 providing expanding liquid refrigerant to the lower illustrated evaporator.

The low pressure evaporated refrigerant from the evaporators is then returned to the compressor 81 via low pressure line 95 (shown to the left in FIG. 1 in dot-dash line with the arrows indicating the direction of flow through heat exchanger 90).

In this fashion, flooded evaporator operation can be obtained with liquid refrigerant passing through each of the evaporator coils, vaporizing as it passes through the coils, thus maximizing refrigerant effects, and providing for uniformity of refrigerant gradient across the cells in the grid.

Hot gas bypass line 97 extends from the outlet of compressor 81 through solenoid actuated hot gas valve 98 to distributer 97 just beyond the expansion valve 91. The compressed hot refrigerant is then fed through refrigerant lines 93 and 94 to the evaporator coils 16 of the ice forming assemblies 10 to heat and release any ice formed in the grid cells 27.

CONTROL SYSTEM

In accordance with the present invention, the control system as illustrated in FIG. 2 comprises an electrical circuit coupled to an appropriate source of alternating current 100 through a bin thermostat 102 and any other appropriate initiating switching, such as may be desired, of the type described in the aforedescribed prior art. As illustratively shown, when the bin thermostat switch 102 (or such initiating switching as employed) is closed, a circuit is completed to the compressor motor 104, and the condenser fan motor 106.

Actuator motor relay 50 is of a double pole, double throw, type having switch terminals 2,3 and 5,4 normally closed, as illustrated by the solid position shown in the drawing, with the dotted line position 2,1 and 5,6 being positions to which the switch may be thrown.

Terminal 5 of actuator motor relay 50 is coupled to terminal 6 of defrost control 108, which is a timer actuated double pole, double throw, switch having normally closed contacts 8,5 and 1,4, as shown by the solid line position in the drawing. A timer, such as Dayton Manufacturing Company's Model 5X829 is suitable having manually controlled variable interval timer 109.

Terminal 1 of the defrost control is coupled to the cycle control 110, which is a pressure responsive switch such for example as Ranco Model No. 1402, or The Penn Controls Co. Model P20BB-1. Cycle control switch 110 normally completes the circuit between the terminals 2,3. However, when pressures below 18 psi are sensed, the normally opened terminals 1,2 are closed, completing the circuit between terminals 5,6 on actuator motor switch 112, to the downwindings on actuator motor 40.

OPERATION

The aforedescribed refrigeration system, water supply system, and control system components may be assembled utilizing conventionally available assembly techniques into a structure as above described and here-with illustrated. The ice forming assembly 10 will be positioned in an area where desired ice is to be produced, such for example as a restaurant, hotel, or the like area, where it is desired to provide ice for use in conjunction with food and drink and/or any other commercial or industrial uses. The ice forming enclosure 14 is preferably formed of a grid having cells 27 which will provide ice cubes. However, as will be appreciated by those skilled in the art, any desired ice shape may be provided, utilizing the techniques here described. This ice forming assembly 10 as above described, is arranged in an appropriate housing, preferably formed of sheet metal and supported by an angle iron framework in conventional fashion. The compressor/condenser assembly 80 is located at some remote point, preferably externally of the room or other area where the ice forming assembly 10 is positioned. This may be on a rooftop, in a basement, or any outside area where requisite cooling may be provided for the condenser, either by utilization of air, or water. Refrigerant line connections are made as above described from the compressor/condenser assembly 80 to the ice forming assembly 10. Thereafter, the equipment is ready to form ice.

During the freezing cycle, the bin thermostat 102 will sense the need for more ice, and manual or other conventional switching may be employed to complete the the circuit to the compressor 104 and condenser fan motor 106 (assuming that the condenser is air cooled). As seen in FIG. 2, the circuit is also completed to the actuator motor relay 50, the cycle control 110, and the spring loaded pump and defrost switch 60. The arm of pump and defrost switch 60 is held in the dotted line position making the circuit between terminals 1,3 by the action of push rod 53, which is urged by platen 18 to an upward position moving the handle of switch 60 to an upward position. Pump and defrost switch 60 in the 1,3 position completes a circuit to the water pump 75 which pumps water from the water pan 70 through the ducts 36 in the platen 18, and up through platen openings 38 into each of the grid cells 27, as best seen in FIG. 1.

The compressor is compressing the gaseous refrigerant into a liquid which is fed to the condenser coils where it is further cooled, and then fed through the heat exchanger 87 to the reservoir whence the refrigerant in a liquid stage is fed through liquid line 89 through heat exchanger 90 to expansion valve 91. The refrigerant is reduced in pressure whence it is fed through distributor 90 from which two refrigerant supply lines 93 and 94 lead through the pressure sensing switch of the control to the evaporator coils 16. From the evaporators the, by this time vaporized refrigerant is returned through heat exchanger 90 by the return line 95 as seen to the left in FIG. 1 to the compressor 81. As will be apparent to those skilled in the art, this system is preferably so set up that the refrigerant fed into each of the evaporator coils is at least partially liquid, so as to provide for flooded evaporator operation with some liquid refrigerant available throughout each of the evaporator coils for conversion to a vapor, with the increased heat of vaporization required, serving to increase the efficiency of heat removal from the ice forming cells, and providing for a uniform refrigerant gradient across the grids.

When the freezing cycle has progressed to a point where the evaporator is ready for harvest, in accordance with the invention, this will be determined by sensing the refrigerant pressure in the lines 93 and 94 supplying refrigerant to the evaporators. At a pressure setting such that ice will have been formed, the cycle control switch 110 moves from the solid line 2,3 position illustrated to make the circuit between the 2,1 terminal, completing the circuit to terminal 5 of the actuator toggle switch 112, thus completing the circuits to the down winding of actuator motor 40, causing the platen 18 to start moving away from the ice forming grid 14 to the position shown in FIG. 1. During the movement of the platen 18, the push rod 53 releases its upward pressure on pump and defrost toggle switch 60, permitting the switch to return to its normally closed solid line position, making the circuit between terminals 1,2 as illustrated in FIG. 2, thus setting up the circuit to the water valve 64, and the hot gas valve 98. The circuit between terminals 1,3 as illustrated in FIG. 2 is now open and the water pump is off.

As the connecting rod 44 continues to lower the platen 18, rod 48 throws the actuator toggle switch 112 to disconnect terminals 5,6 deactivating the downward movement of the actuator motor. The water pump continues to operate washing the platen and collecting in the pan.

The variable timer 109 is now running while the cycle control 110 in the solid line 2,3 position makes the circuit to the upwindings.

When the evaporator temperature has risen sufficiently to harvest the cubes, the timer will have run its preset interval, switching the switch arm of switch 108 to the dotted line 8,6 and 1,3 settings, providing energizing power to the upwinding of the actuator motor, which now raises the platen to the grid closing position. The push rod will move switch 60 to the 1,3 position, disconnecting water flow, and shutting down the defrost valve, while energizing the water pump. The actuator motor relay 50 will switch contacts from position 5,6 and 2,1 to position 5,4 and 2,3. The 2,3 circuit sets up the secondary circuit to complete the upward travel of the actuator motor.

In accordance with the novel control circuit, in the event of any ice cubes "hanging up" on the platen 18, to jam between the platen and the grid, the cycle is prevented from being reinitiated, since the toggle switch 60 will not be actuated by the push rod, and thus will continue to supply power to the 5,6 terminals of the actuator relay circuit to cause the actuator motor to travel downward again.

The above disclosure has been given by way of illustration and elucidation, and not by way of limitation, and it is desired to protect all embodiments of the invention within the scope of the appended claims.

What is claimed is:

1. In an ice making machine having an ice forming enclosure; a refrigeration system; having an evaporator through which evaporating refrigerant is passed in heat exchange relationship with said enclosure to cool said ice forming enclosure during a freezing cycle; valve means in said refrigeration system permitting the flow of hot refrigerant gas to said evaporator to heat said ice forming enclosure to harvest the ice therefrom during a harvest cycle; and water supply means supplying water to said ice forming enclosure; control means for automatically cycling the machine through freezing and ice harvesting cycles, said control means comprising: a pressure responsive switch responding to pressures in the evaporator of the refrigeration system indicating the formation of ice in said ice forming enclosure, said pressure sensitive switch arranged in a circuit controlling said valve means and said water supply means to cause said valve means to permit the flow of hot refrigerant into heat exchange relationship with said enclosure to effect defrost when a given pressure condition has been sensed, and to discontinue the flow of water to said ice forming enclosure; and a timer in an electrical circuit with said pressure sensitive switch, said timer causing said switch to move to a position discontinuing defrost and initiating the freezing cycle.

2. In an ice making machine as in claim 1, in which the timer is a manually controlled variable interval timer subject to selective adjustment by the user of the apparatus.

3. In an ice making machine as in claim 1, in which said refrigeration system is a compression refrigeration system comprising a refrigerant compressor; a refrigerant condenser coupled to receive compressed refrigerant from said compressor and coupled to direct the condensed refrigerant to said evaporator, said compressor and condenser located at a point sufficiently removed from said ice forming enclosure so that the heat dissipated in said condenser and compressor will not effect the ice formed in said enclosure.

4. In an ice making machine as in claim 3, in which a plurality of ice forming enclosures are provided each having an evaporator in heat exchange relationship with said enclosure, said evaporators connected in parallel to receive refrigerant from said compressor.

5. In an ice making machine as in claim 4, a housing enclosing said ice forming enclosures, said enclosures arranged at a spaced vertical distance apart, and a vertical passageway along one said of said housing, at a side of said enclosures through which the ice formed in said enclosures may be passed.

* * * * *